US006375187B1

(12) United States Patent
Baerlocher

(10) Patent No.: US 6,375,187 B1
(45) Date of Patent: Apr. 23, 2002

(54) GAMING DEVICE HAVING IMPROVED OFFER AND ACCEPTANCE BONUS SCHEME

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/680,630

(22) Filed: Oct. 6, 2000

(51) Int. Cl.[7] ..... A63F 9/24
(52) U.S. Cl. ..... 273/143 R; 463/20; 463/25
(58) Field of Search ..... 273/138.1, 138.2, 273/143 V, 292; 463/20, 1, 9, 11–13, 16, 25

(56) References Cited

U.S. PATENT DOCUMENTS

| | | | | |
|---|---|---|---|---|
| 4,624,459 A | | 11/1986 | Kaufman | |
| 4,695,053 A | | 9/1987 | Vazquez, Jr. et al. | |
| 5,046,737 A | * | 9/1991 | Fienberg | 273/139 |
| 5,342,047 A | | 8/1994 | Heidel et al. | |
| 5,511,781 A | * | 4/1996 | Wood et al. | 273/85 CP |
| 5,967,894 A | | 10/1999 | Kinoshita et al. | |
| 6,015,346 A | | 1/2000 | Bennett | |
| 6,033,307 A | | 3/2000 | Vancura | |
| 6,102,798 A | | 8/2000 | Bennett | |
| 6,117,009 A | * | 9/2000 | Yoseloff | 463/20 |
| 6,159,097 A | | 12/2000 | Gura | |
| 6,174,235 B1 | | 1/2001 | Walker et al. | |
| 6,203,429 B1 | | 3/2001 | Demar et al. | |
| 6,210,279 B1 | | 4/2001 | Dickinson | |

FOREIGN PATENT DOCUMENTS

| | | | |
|---|---|---|---|
| EP | 0 984 409 A2 | 8/2000 | |
| GB | 2100905 A * | 1/1983 | 273/143 R |

OTHER PUBLICATIONS

Top Dollar published by IGT in 1998, 2 pages.

* cited by examiner

*Primary Examiner*—Mark Sager
(74) *Attorney, Agent, or Firm*—Bell, Boyd & Lloyd LLC

(57) ABSTRACT

The present invention is a gaming device having an improved offer and acceptance bonus scheme wherein the player has an opportunity to determine the number of offers the player may obtain during the bonus round and after the gaming device selects one of the possible award offers to the player the gaming device prevents that offer from being made to the player again.

27 Claims, 5 Drawing Sheets

GAMING DEVICE HAVING IMPROVED OFFER AND ACCEPTANCE BONUS SCHEME

CROSS-REFERENCE TO RELATED APPLICATIONS

This application is related to the following co-pending commonly-owned patent applications: "GAMING DEVICE HAVING SEPARATELY CHANGEABLE VALUE AND MODIFIER BONUS SCHEME," Ser. No. 09/626,045, "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 091680, 601, "GAMING DEVICE HAVING VALUE SELECTION BONUS," Ser. No. 09/684,605, "GAMING DEVICE HAVING RISK EVALUATION BONUS ROUND," Ser. No. 09/688,434, "GAMING DEVICE HAVING OFFER ACCEPTANCE GAME WITH TERMINATION LIMIT," Ser. No. 09/822,711, and "GAMING DEVICE HAVING OFFER/ACCEPTANCE ADVANCE THRESHOLD AND LIMIT BONUS SCHEME," Ser. No. 09/838,014.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an improved offer and acceptance bonus scheme.

BACKGROUND OF THE INVENTION

Gaming devices, such as slot machines, having primary and secondary or bonus games or schemes are well known. One well known bonus game provides a player with a series of award offers consisting of credits or dollars. The player may either accept each award offer or reject each award offer; however, the player must accept the final award offer. If the player accepts an award offer, the player keeps the award offered. If the player rejects the award offer, the gaming device provides another award offer to the player except if the award offer is the final award offer. The award offers are randomly determined from a series of award offers of differing values. As illustrated in FIG. 3, the potential award offers 52 are displayed to the player, each award offer made by the game is displayed in an offer display 54, the number of offers remaining are displayed in an offer remaining display 56, and accept and reject buttons 58 and 60, respectively, enable the user to accept or reject the offers.

Several different embodiments of this type of bonus scheme for a gaming device have been implemented in gaming machines of various types. While this type of gaming device has achieved significant popularity in the gaming industry, after playing the game repeatedly, players may lose interest in the game. Accordingly, there is a need for new gaming devices related to this type of offer and acceptance bonus scheme.

SUMMARY OF THE INVENTION

The present invention provides a gaming device having an improved offer and acceptance bonus scheme. In one embodiment of the improved offer and acceptance bonus scheme of the present invention, the gaming device provides the player an opportunity to determine the number of offers the player may obtain during the bonus round. In particular, this embodiment provides the player with a plurality of masked selections or symbols. The player selects one of the symbols and the gaming device reveals the number of offers associated with the selected symbol. The player obtains the revealed number of offers for use in the offer and acceptance bonus scheme as described above. The gaming device also reveals the number of offers associated with the non-selected symbols. One preferred embodiment includes three symbols and a different number of offers (i.e., three, four and five) associated with the symbols. It should be appreciated that the number of offers associated with each symbol may be randomly determined. The specific number of offers associated with each symbol is randomly determined for each round of the bonus scheme.

In an alternative embodiment of the improved offer and acceptance bonus scheme of the present invention, after the gaming device selects (and displays) one of the possible award offers to the player (such as the one hundred offer 52*a* illustrated in FIG. 3), the gaming device prevents that offer from being made to the player again. In other words, the gaming device removes, eliminates or nullifies a previously offered award from the random determination subsequently made for additional award offers.

It should be appreciated that both of the embodiments of the improved acceptance and offer bonus scheme of the present invention can be simultaneously implemented in a single bonus round or each implemented individually in different bonus rounds. The determination of when to implement such alternative embodiments could also be randomly determined.

It is therefore an object of the present of the present invention to provide a gaming device having an improved offer and acceptance bonus scheme.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
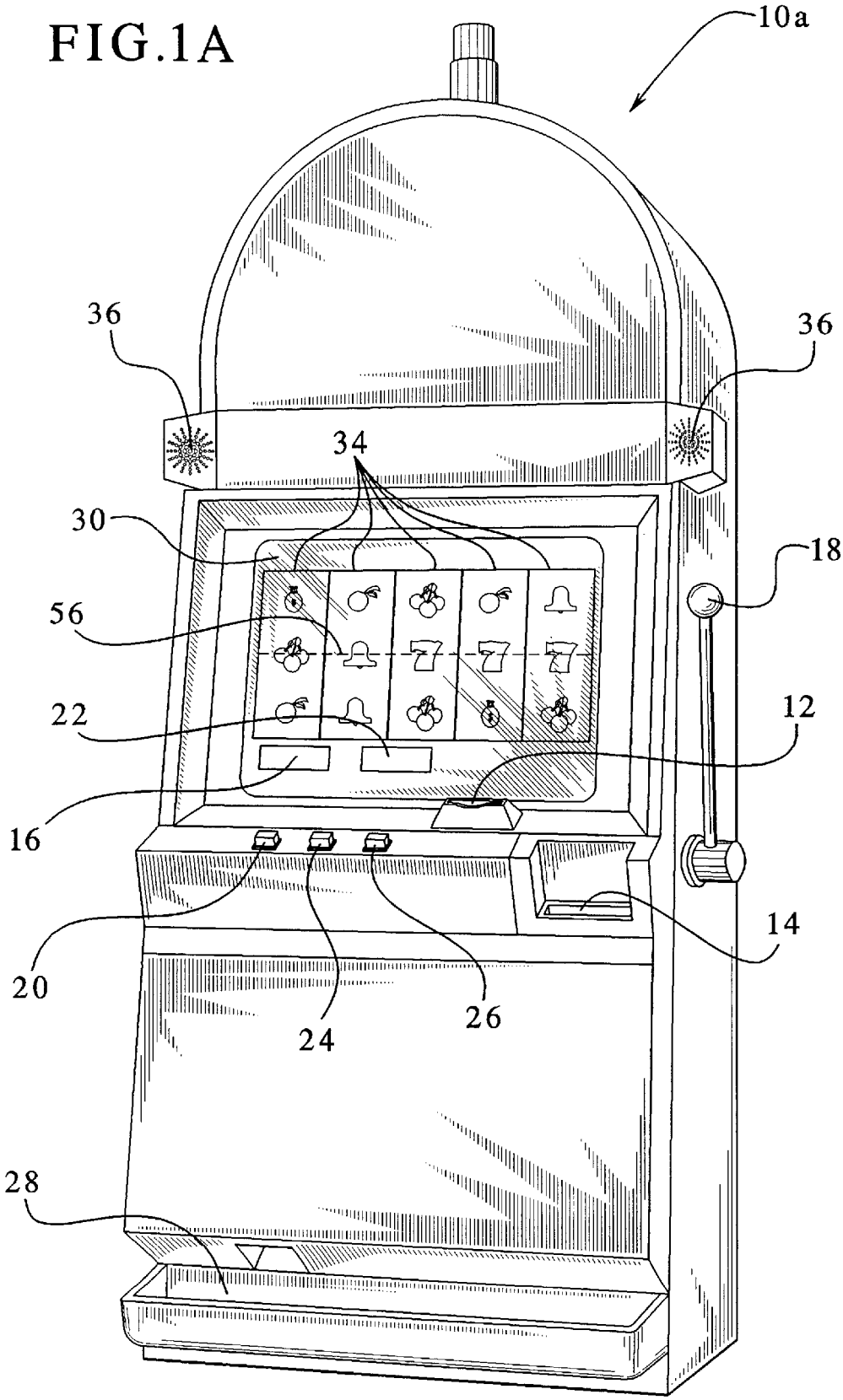
FIGS. 1A and 1B are perspective views of alternative embodiments of the gaming device of the present invention.
Figure 1B:
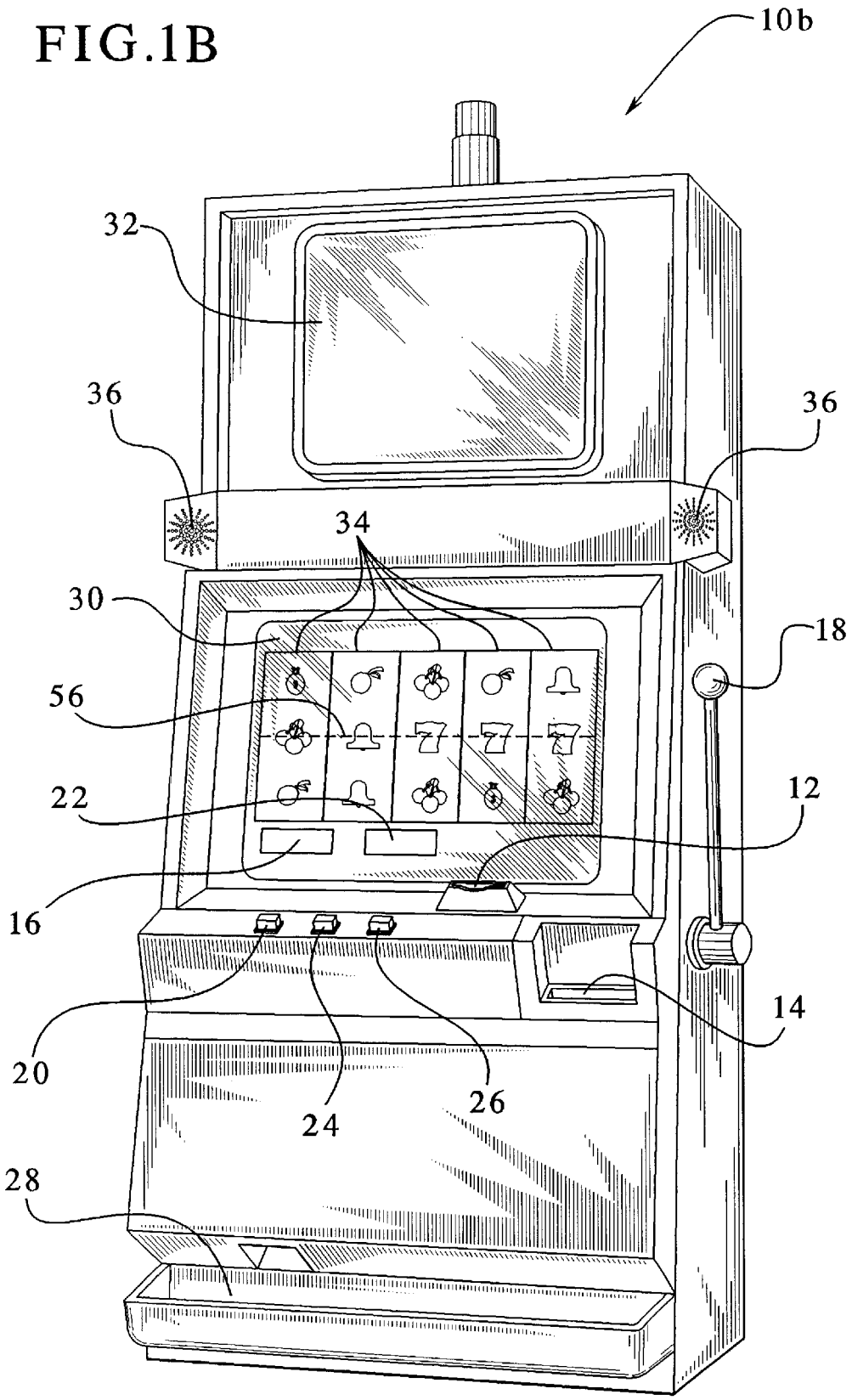

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sifting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
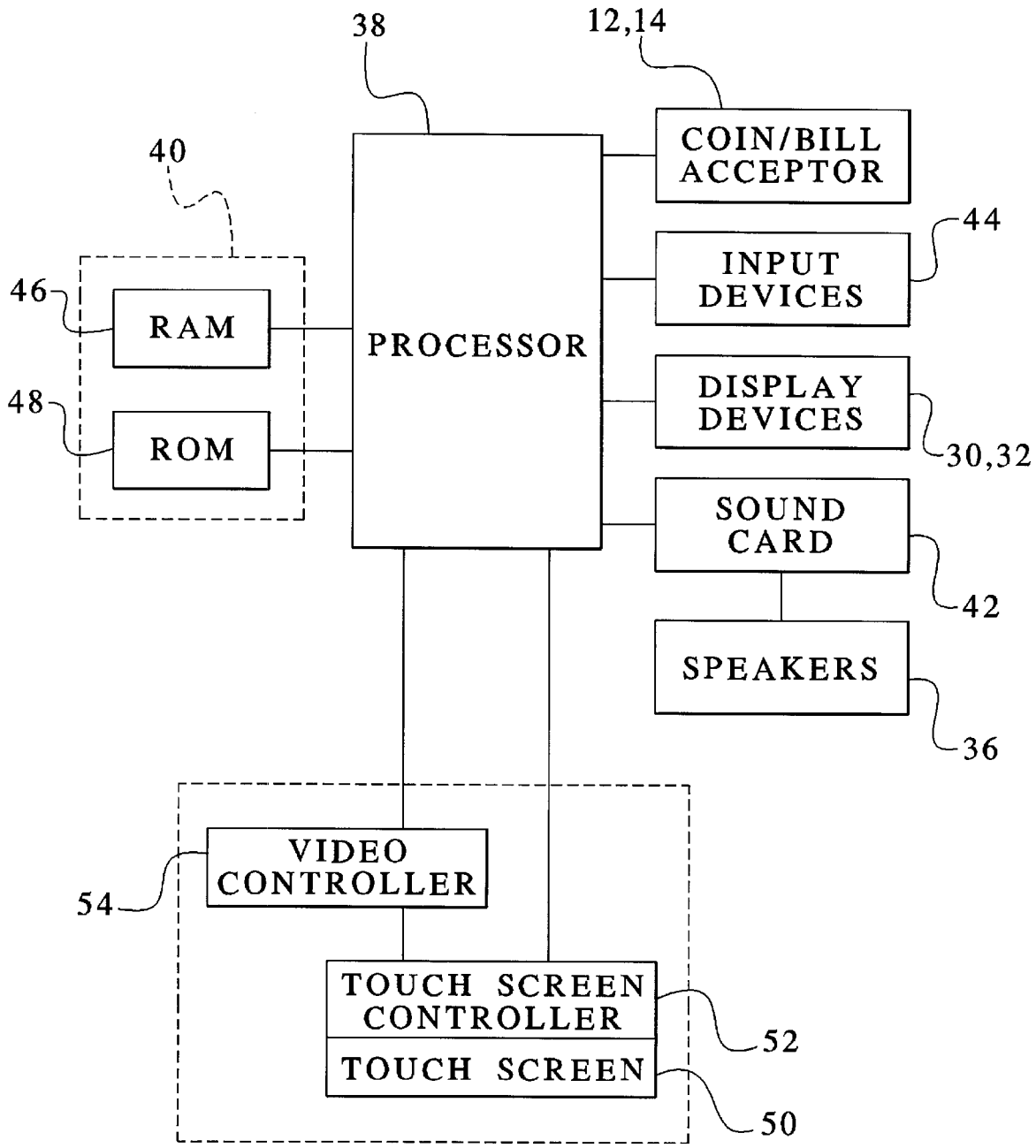
FIG. 2 is a schematic block diagram of the electronic configuration of one embodiment of the gaming device of the present invention.
Figure 3:
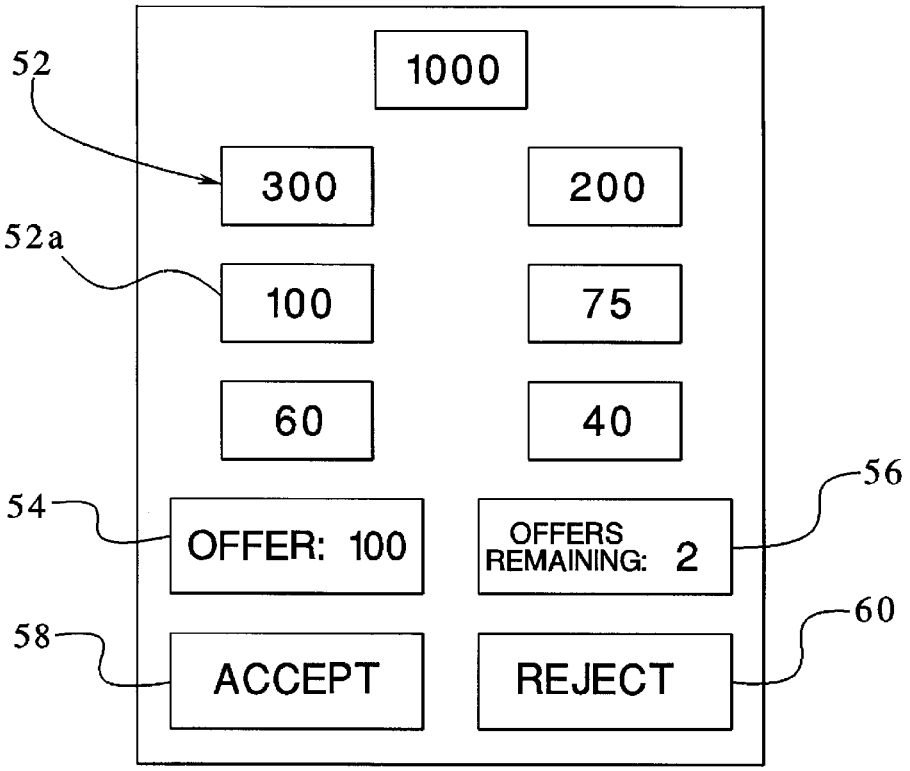
FIG.3 (PRIOR ART)
FIG. 3 is a front elevational view of a prior art offer and acceptance bonus scheme.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

Improved Bonus Scheme

Figure 4A:
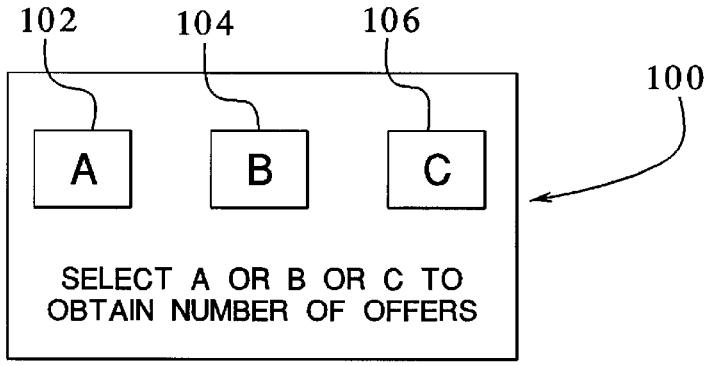
FIG. 4A is a front elevational view of a number of offers determination screen of one embodiment of the improved offer and acceptance bonus scheme of the present invention illustrating a plurality of selections which the player can select to obtain a number of offers.
Figure 4B:
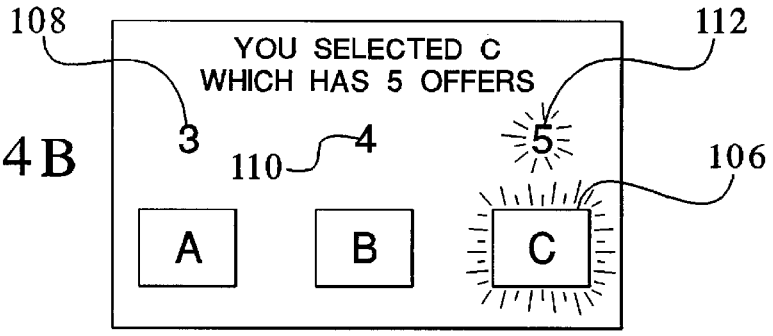
FIG. 4B is a front elevational view of a number of offers determination screen of one embodiment of the improved offer and acceptance bonus scheme of the present invention illustrating the one selection chosen by the player and the number of offers associated with said selection and the other selections.

Referring now to FIGS. 4A and 4B, one embodiment of the improved offer and acceptance bonus scheme of the present invention provides a screen or display 100 (which is preferably a touch screen) which enables the player to make a selection to obtain the number of offers the player may use in connection with an offer and acceptance bonus scheme. The game preferably provides a plurality of selections which the player may select from. For example, in one embodiment, there are three selections 102, 104 and 106 labeled A, B and C, respectfully. The player chooses selection A, selection B or selection C to obtain a number of offers. A predetermined or randomly determined number of offers is associated with each selection 102, 104 and 106. After the player makes a selection as indicated by the highlighted selection 106 in FIG. 4A, the gaming device reveals the number of offers 108, 110 and 112, respectively, associated with each selection. In FIG. 4A, the player selected selection C which had five offers (i.e., the maximum number of offers) associated therewith. If the player would have chosen selection A, the player would have received three offers and if the player had selected selection B, the player would have received four offers. It should be appreciated that each such offer is an opportunity for the player to obtain an award offer and that the player does not have to use each offer. Appropriate messages such as "SELECT A OR B OR C TO OBTAIN NUMBER OF OFFERS" and "YOU SELECTED C WHICH HAS 5 OFFERS" are preferably provided to the player visually, or through suitable audio or audiovisual displays. Although not shown, the display could inform the player of the number of possible offers the player may obtain.

Figure 5A:
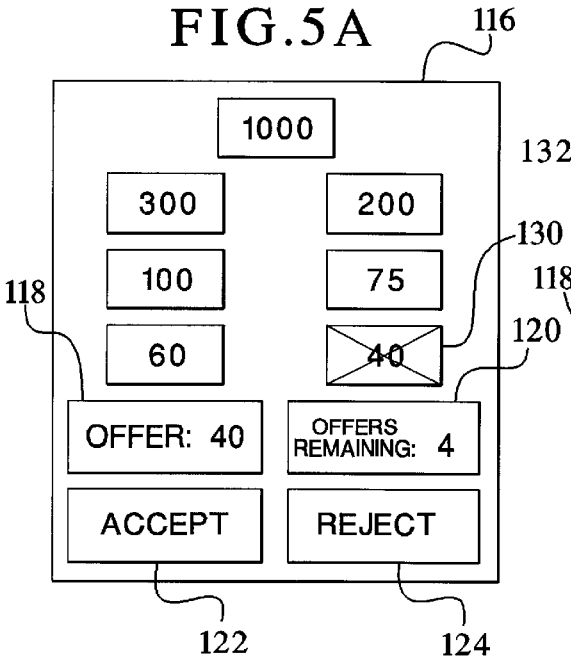
FIGS. 5A, 5B, 5C and 5D are front elevational views of an offer display of an alternative embodiment of the improved offer and acceptance bonus scheme of the present invention graphically illustrating the removal of the award offers from the potential award offers.

As further illustrated in FIG. 5A, the gaming device provides the player with an offer and acceptance display 116 (which is preferably a touch screen) which provides the player with the first award offer in the offer display 118 and the number of offers remaining in the offers remaining display 120. In this case, the first award offer is forty and the number of remaining offers is four, for a total of five offers. The player may accept this award offer or reject the award offer and continue to use each of the remaining offers prior to the time the player accepts an award offer or the last offer is made to the player. Once the player accepts an award offer, the gaming device provides the player with the award and the player cannot obtain any more award offers. If the player rejects all of the offers (prior to the last offer), the gaming device provides the player with the last offer (i.e., the player cannot reject the last offer).

Referring now to FIGS. 5A, 5B, 5C and 5D, in a further alternative embodiment of the present invention, the player is provided with a forty award offer 130, and has four offers remaining. In this embodiment, the forty award offer 130 is graphically illustrated with an "X" through it. This is a graphical illustration that if the player chooses to reject the award offer and have the gaming device select a further award offer, the gaming device will not reselect the forty award offer and will randomly determine from the other award offers which award offer the gaming device will make to the player. It should be appreciated that the game of the present invention could communicate the removed award offer to the player in any suitable manner.

Figure 5B:
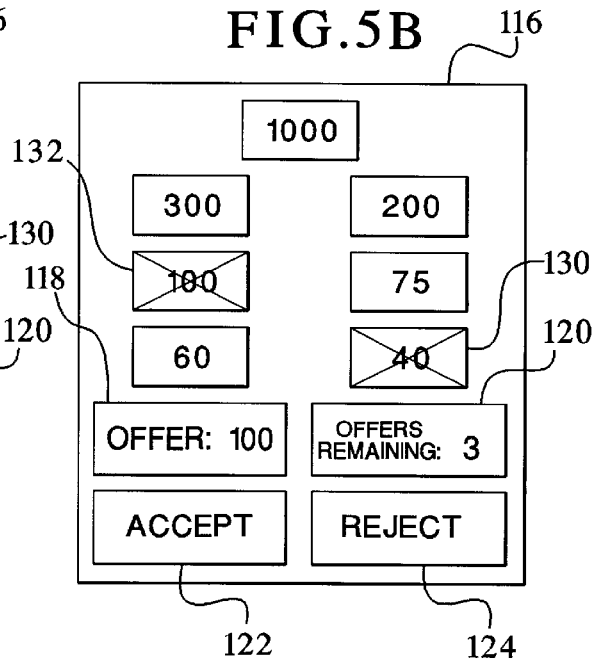

Assuming the player rejects the forty award offer using the reject button or indicator 124, the forty offer is no longer available to be offered to the player. FIG. 5B illustrates that the next award offer made by the gaming device is one hundred and the player has three offers remaining. In addition to the forty award offer 130 being eliminated, the one hundred award offer 132 is eliminated as graphically illustrated by the "X" in FIG. 5B.

Figure 5C:
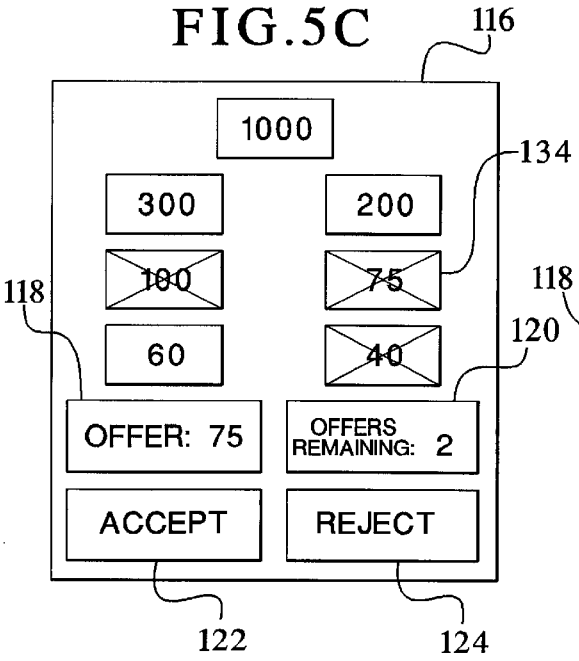

Assuming the player also rejects this award offer, FIG. 5C illustrates that the next award offer made by the gaming device is seventy-five and the player has two offers remaining. Again, in addition to the one hundred award offer and the forty award offer being removed or eliminated, now the seventy-five award offer 134 also has an "X" through it to graphically illustrate the removal or elimination of the seventy-five award offer 134. Again, it should be appreciated that the elimination or removal of the offer may be displayed or communicated in any suitable manner to the player. It should be appreciated that the probability of obtaining some or all of the other award offers preferably increases when an award offer is removed or that the probabilities of obtaining each remaining award offer could be re-weighted.

Figure 5D:
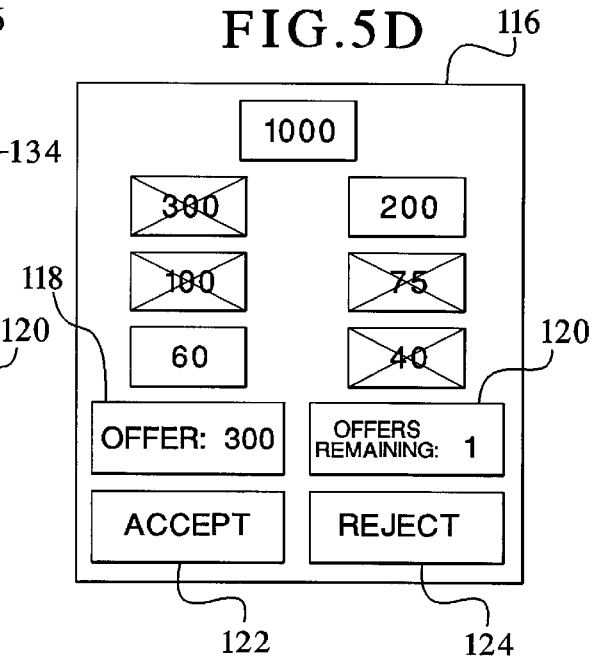

Assuming the player also rejects this award offer, in FIG. 5D the award offer is three hundred and the player has one offer remaining. More likely than not, the player will opt to accept this award offer by using the accept button or indicator 122. The display 116 graphically shows that the three hundred award offer is also now eliminated and if the player chooses to reject the award offer, the gaming device will randomly choose or select between the remaining award offer from the 1,000 award offer, the 200 award offer and the 60 award offer to provide the player with a new and final or last offer. Accordingly, the gaming device provides the player with a decreased number of potential award offers after each rejection of an award offer. It should be appreciated that at any time, such as on the last award offer, the gaming scheme could add back one or more of the removed award offers. It should also be appreciated that after an award offer, the game could randomly determine which, if any, award offer to eliminate or remove instead of removing the offered award offer.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device having a bonus scheme comprising:

a controller;

a plurality of award offers;

an award offer display connected to said controller;

an offers remaining display connected to said controller;

means connected to said controller for enabling a player to accept or reject an award offer randomly selected by the controller and made to the player; and means connected to the controller for randomly determining a maximum number of award offers the player may receive from at least two different potential numbers of award offers.

2. The gaming device of claim 1, wherein the determining means includes a plurality of selections, a number of award offers associated with each selection and means connected to the controller for enabling a player to select one of said selections.

3. The gaming device of claim 2, wherein the number of award offers associated with each selection is randomly determined by the controller.

4. The gaming device of claim 2, wherein the number of award offers associated with each selection is determined by the controller each time the bonus scheme is triggered.

5. The gaming device of claim 2, which includes means for eliminating an award offer after said award offer is offered to said player.

6. A gaming device having a bonus scheme comprising:

a plurality of award offers wherein the award offer display includes means for communicating the elimination of each rejected award offer to the player, which includes a plurality of selections, a number of award offers associated with each selection and means connected to the controller for enabling said player to select one of said selections to determine the maximum number of award offers made to the player in the bonus game;

a controller for randomly selecting award offers from said plurality of award offers to offer to a player and for eliminating each selected award offer made to the player from the plurality of award offers which may be subsequently selected by the controller if said selected award offer is rejected by the player;

an award offer display connected to said controller;

an award offers remaining display connected to said controller; and means connected to said controller for enabling a player to accept or reject one of the award offers made to the player by the controller from non-eliminated award offers.

7. A method for operating a gaming device, said method comprising the steps of:

(a) triggering a bonus round;

(b) randomly determining a number of offers a player may receive from at least two different numbers of offers, including a last offer;

(c) randomly selecting an award offer from a plurality of award offers and communicating said selected award offer to said player;

(d) enabling said player to accept or reject said selected award offer;

(e) repeating steps (c) and (d) if said player rejects said selected award offer and the selected award offer is not the last offer;

(f) providing the award offer to the player if the player accepts said selected award offer or if the selected award offer is the last offer; and (g) terminating the bonus round.

8. The method of claim 7, wherein the step of randomly determining the number of offers includes providing a plurality of selections, a number of offers associated with each selection and enabling a player to select one of said selections.

9. The method of claim 7, which includes nullifying an award offer after said award offer is offered to said player.

10. The method of claim 9, which includes communicating said nullification of said award offer to said player.

11. The method of claim 7, which includes nullifying a randomly determined award offer after an award offer is offered to said player.

12. The method of claim 7, wherein step (d) includes enabling the player to select a previously selected award offer.

13. A method for operating a gaming device, said method comprising the steps of:

(a) triggering a bonus round;

(b) randomly selecting an award offer from a plurality of non-nullified award offers and communicating said selected award offer to a player;

(c) enabling said player to accept or reject said selected award offer;

(d) nullifying said selected award offer from said plurality of award offers if said player rejects said selected award offer;

(e) repeating steps (b) through (d) if said player rejects said selected award offer and the award offer is not a last offer;

(f) providing the selected award offer to the player if the player accepts said selected award offer or if the selected award offer is the last offer; and (g) terminating the bonus round which includes the step of randomly determining the number of offers provided to the player.

14. A gaming device comprising:

a plurality of potential offers;

a processor for randomly selecting offers to be made to a player from said plurality of potential offers;

an offer display controlled by the processor for displaying to the player the offers selected by the processor from said plurality of potential offers;

an offer acceptor controlled by said processor;

an offer rejector controlled by said processor;

a plurality of selections and a selection indicator controlled by the processor; and a number associated with each selection, at least two of said numbers being different, and said number associated with the selected selection being the maximum number of offers made by the processor to the player.

15. The gaming device of claim 14, wherein the processor selects said offers to be made to the player in a bonus game.

16. The gaming device of claim 14, wherein the plurality of selections are player selectable using said selection indicator.

17. The gaming device of claim 14, which includes a display device in communication with the processor which displays the selections and includes the selection indicator.

18. The gaming device of claim 17, wherein the selection indicator of the display device is a touch screen.

19. The gaming device of claim 14, which includes a display device in communication with the processor, wherein the display device displays the potential offers and includes the offer display for displaying selected offers to the player.

20. The gaming device of claim 19, wherein the displaying device displays the offer acceptor and offer rejector.

21. The gaming device of claim 14, wherein the processor provides an award to the player which is either an accepted offer or a final offer based on said maximum number of offers.

22. The gaming device of claim 14, which includes an offers remaining display controlled by said processor for displaying to the player the number of offers remaining to be made by the processor based on the maximum number of offers made by the processor to the player.

23. The gaming device of claim 14, wherein the plurality of potential offers includes eliminated potential offers and non-eliminated potential offers, and wherein said processor randomly selects offers to be made to the player from said non-eliminated potential offers.

24. A gaming device comprising:

a plurality of potential offers which includes eliminated potential offers and non-eliminated potential offers;

a processor for randomly selecting offers to be made to a player from said non-eliminated potential offers and for eliminating offers rejected by the player;

an offer display controlled by the processor for displaying to the player the offers selected by the processor from said non-eliminated potential offers;

an offer acceptor controlled by said processor; and an offer rejector controlled by said processor which includes a display device in communication with the processor, wherein the display device displays the potential offers and includes the offer display for displaying selected offers to the player, wherein the display device displays the offer acceptor and the offer rejector, which includes a plurality of selections and a number associated with each selection, said number being the maximum number of offers made by the processor to the player.

25. A gaming device comprising:

a plurality of potential offers which includes eliminated potential offers and non-eliminated potential offers;

a processor for randomly selecting offers to be made to a player from said non-eliminated potential offers and for eliminating offers rejected by the player;

an offer display controlled by the processor for displaying to the player the offers selected by the processor from said non-eliminated potential offers;

an offer acceptor controlled by said processor;

an offer rejector controlled by said processor;

a plurality of selections;

a number associated with each selection, at least two of said numbers being different, and said number associated with the picked selection being the maximum number of non-eliminated offers made by the processor to the player; and an offers remaining display controlled by said processor for displaying the number of offers remaining to be made by the processor to the player based on the maximum number of offers made by the processor to the player.

26. In a gaming machine having a bonus scheme including a plurality of award offers, an award offer display, an offers remaining display, an award offer acceptor, an award offer rejector and a processor for communicating with said award offer display, said offers remaining display, said award offer acceptor and said award offer rejector, and for randomly selecting the award offers to be made to a player, the improvement comprising: a plurality of selections, a number of offers associated with each selection, at least two of the numbers of offers being different, and a selection indicator, wherein said processor communicates with the selection indicator and limits the number of offers provided to the player based on the number of offers associated with one of the selections which is picked by the player.

27. The gaming machine of claim 26, wherein the processor provides an award to the player which is either an accepted offer or a final offer based on said number of offers associated with the selection picked by the player.

* * * * *

UNITED STATES PATENT AND TRADEMARK OFFICE

CERTIFICATE OF CORRECTION

PATENT NO. : 6,375,187 B1
DATED : April 23, 2002
INVENTOR(S) : Anthony J. Baerlocher It is certified that error appears in the above-identified patent and that said Letters Patent is hereby corrected as shown below:

Column 2,
Line 43, change “of the present of the present” to -- of the present --.

Column 3,
Line 23, change “sifting” to -- sitting --.

Column 7,
Line 44, change “bonus game” to -- bonus scheme --.

Signed and Sealed this

First Day of October, 2002

*Attest:*

*Attesting Officer*

JAMES E. ROGAN
*Director of the United States Patent and Trademark Office*